United States Patent [19]

Boulva

[11] 4,047,342

[45] Sept. 13, 1977

[54] PANEL ASSEMBLY

[76] Inventor: Paul Boulva, 7425 Canora Rd. Ville, Mount-Royal, Quebec, Canada, H3P 2H9

[21] Appl. No.: 574,367

[22] Filed: May 5, 1975

[51] Int. Cl.[2] ..... E04B 2/74

[52] U.S. Cl. ..... 52/239; 52/71; 52/301; 52/586; 160/351

[58] Field of Search ..... 52/71, 239, 36, 280, 52/65, 301, 238, 582, 496, 586; 160/135, 351

[56] References Cited

U.S. PATENT DOCUMENTS

| | | | |
|---|---|---|---|
| 328,342 | 10/1885 | Robinson | 160/229 |
| 528,358 | 10/1894 | Brown | 160/229 |
| 543,906 | 8/1895 | Spauling | 160/229 |
| 1,300,722 | 4/1919 | Gray | 160/229 |
| 2,855,037 | 10/1958 | Stiffel | 160/135 |
| 2,882,564 | 4/1959 | Couse et al. | 52/465 |
| 3,343,318 | 9/1967 | Birum, Jr. | 52/586 X |
| 3,425,171 | 2/1969 | Propst et al. | 52/239 X |
| 3,428,108 | 2/1969 | Singer | 52/239 X |
| 3,430,997 | 3/1969 | Propst et al. | 52/758 |
| 3,447,824 | 6/1969 | Brown | 52/282 X |
| 3,486,287 | 12/1969 | Guillon | 52/239 |
| 3,496,889 | 2/1970 | Protzmann et al. | 108/152 |
| 3,517,467 | 6/1970 | Propst | 52/36 |
| 3,659,389 | 5/1972 | Forberg | 52/238 X |
| 3,696,855 | 10/1972 | Kira | 52/586 X |
| 3,762,116 | 10/1973 | Anderson et al. | 52/239 |
| 3,768,222 | 10/1973 | Birum, Jr. | 52/282 |
| 3,788,378 | 1/1974 | Sobel | 160/135 |
| 3,797,184 | 3/1974 | Thompson | 52/239 |
| 3,809,142 | 5/1974 | Bleeker | 160/135 |
| 3,834,092 | 9/1974 | Whisson | 52/36 |
| 3,834,093 | 9/1974 | Tacke | 52/582 X |
| 3,861,101 | 1/1975 | Whisson | 52/238 |
| 3,866,364 | 2/1975 | Pollard | 52/36 |
| 3,889,736 | 6/1975 | Firks | 160/135 |

FOREIGN PATENT DOCUMENTS

| | | | |
|---|---|---|---|
| 814,657 | 6/1969 | Canada | 52/229 |
| 576,448 | 5/1958 | Italy | 52/586 |

*Primary Examiner*—Leslie Braun

*Attorney, Agent, or Firm*—Robic, Robic & Associates

[57] ABSTRACT

Improvements in area space divider assemblies and components therefore. One component is the bridge means used in connecting two or more wall panels together to provide the divider assembly. The bridge means have projecting longitudinal edges equal in number to the number of panels to be joined together. Receiving means are provided at each end of each projecting edge. The receiving means extend longitudinally inwardly of the bridge means from each end and receive vertically extending connecting means on the panels. The bridge means can comprise a single bridge member for joining two, three or four wall panels together; or a bridge assembly consisting of two, three or four bridge members, joined by links, for connecting two, three or four panels. The invention also relates to novel wall panels and space divider assemblies.

25 Claims, 15 Drawing Figures

PANEL ASSEMBLY

This invention is directed toward improvements in space divider assemblies and components used in such assemblies.

Space divider assemblies are well known. Examples of such assemblies are shown in Canadian Pat. No. 816,966, issued July 8, 1969, R.L. Propst et al., inventors; U.S. Pat. No. 3,762,116, issued Oct. 2, 1973, W.C. Anderson, et al., inventors; and U.S. Pat. No. 3,788,378, issued Jan. 29, 1974, S.M. Sobel, inventor. These assemblies permit a floor area to be economically divided into work areas without requiring the use of more expensive floor to ceiling, semi-permanent partitions.

However many of the known assemblies do not provide structures which have adequate strength or rigidity. In known assemblies, the panels forming the major part of the assemblies are joined together at spaced apart points rather than utilizing the entire length of their adjacent vertical edges.

It is therefore the purpose of the present invention to provide a space divider assembly, and components therefore, which have increased strength and rigidity. This is accomplished by providing components which utilize substantially the entire length of the vertical adjacent edges of the panels to be joined in the assembly.

It is a further purpose of the present invention to provide novel space divider assemblies, and components therefore, which are relatively simple and inexpensive to manufacture, which permit rapid and simple assembly of panels used in the space divider assemblies, and which provide flexibility in the format of the assemblies.

The invention, in one embodiment, is particularly directed toward bridge means for use in joining two or more structural wall panels together along adjacent vertical edges to provide a space divider assembly. The bridge means have projecting edges equal in number to the number of panels to be joined together. Receiving means are provided at each end of each projecting edge, the receiving means extending longitudinally inwardly of the bridge means from each end and receiving vertically extending connecting means on the panels.

The bridge means can comprise a single bridge member having two, three or four projecting edges. The bridge means can also comprise a bridge assembly consisting of two, three or four bridge members joined together by connecting links.

The invention is also directed toward a space divider assembly comprising at least two wall panels having vertical end edges and bridge means joining the wall panels together along adjacent vertical edges. The bridge means has projecting edges equal in number to the number of panels to be joined together. Each panel has a bridge locating member along its vertical edge. The member has a longitudinal central slot for receiving one projecting edge of the bridge means.

The invention is further directed toward a wall panel for use in a space divider assembly. The wall panel has vertical end edges with a bridging member affixed to each end edge along its length. Each member has a longitudinal slot for receiving a portion of a bridge means and means are provided at each end of the slot for use in connecting the bridge means to the panel.

The invention will now be described in detail having reference to the accompanying drawings in which.

Figure 1:
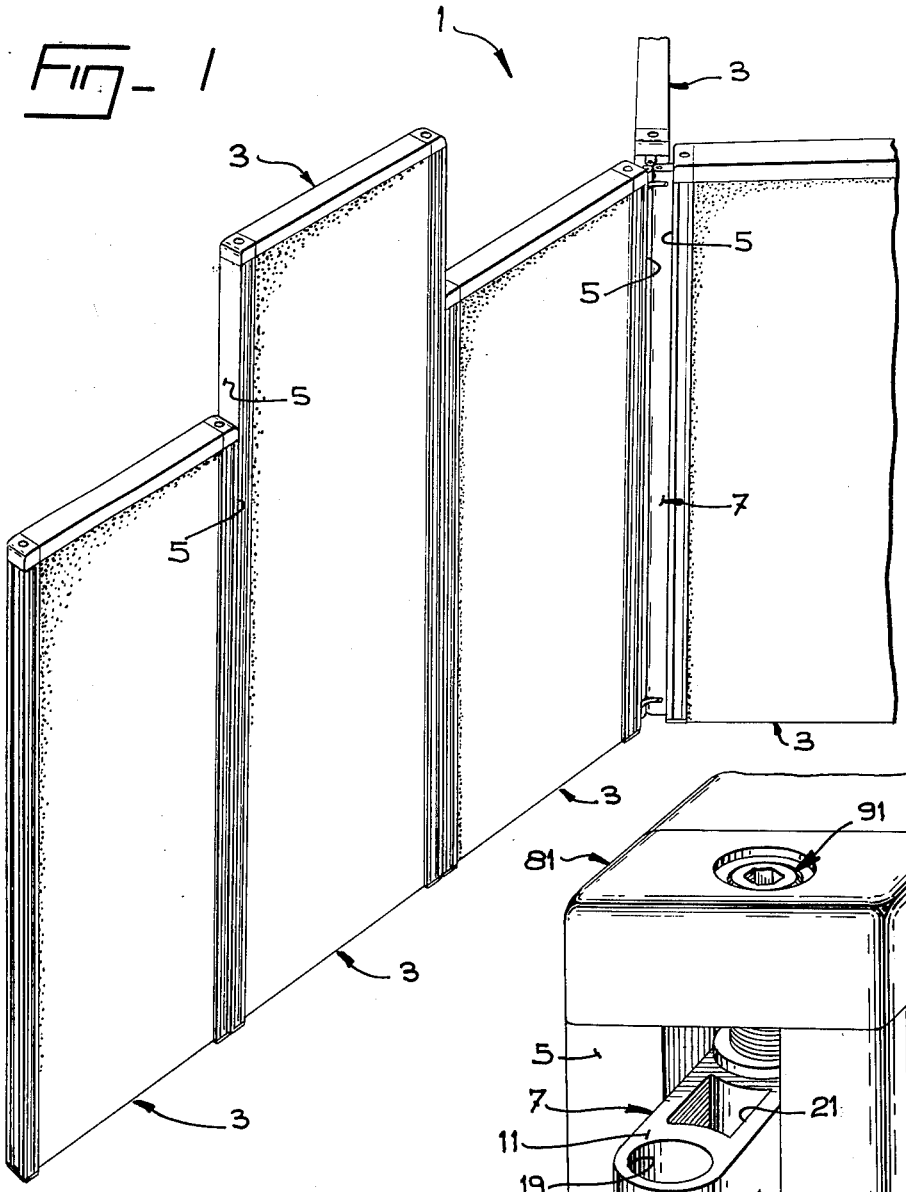
FIG. 1 is a perspective view of a space divider employing divider panels and bridge members of the present invention.
Figure 2:
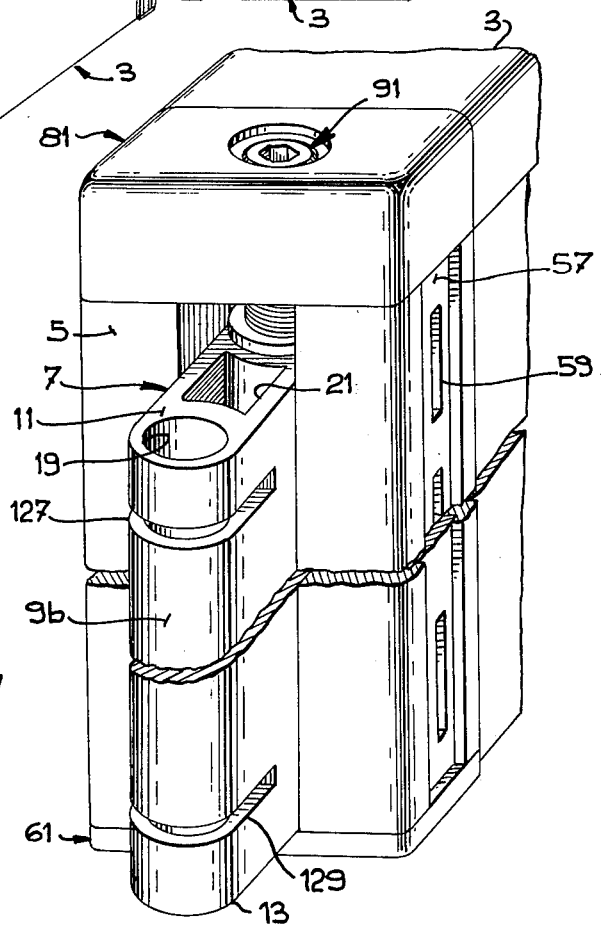
FIG. 2 is a perspective detail view showing a divider panel and a connected bridge member.

The space divider assembly 1 of the present invention, as shown in FIG. 1, comprises a plurality of space divider panels 3, which are preferably rectangular in shape, joined together along adjacent vertical edges 5. Some of the panels in the assembly can be taller then the other panels. Narrow bridging means 7 are provided for use in joining the panels 3 together. The bridging means 7 can be used to join the panels 3 together to form straight wall sections, angled wall sections, branching wall sections, or right-angled wall sections as will be described.

The bridging means 7 have a length substantially equal to the length of the shortest panel 3 used in the assembly. The bridging means 7 have longitudinal extending, projecting edge portions 9, equal in number to the number of panels 3 to be joined together by the bridging means 7. Each longitudinal edge portion 9, at each end 11, 13 of the bridging means 7 has receiving means 15. The receiving means 15 extend longitudinally into the edge portion 9 from each end 11, 13. The receiving means 15 receive connecting means used to join the bridging means 7 to the panels 3 as will be described.

In one embodiment of the invention, as shown in FIGS. 2 to 5, the bridging means 7 can comprise a single, elongated bridging member 17. This member 17 has a narrow, substantially rectangular cross-section thus providing opposed narrow, longitudinal extending edge portions 9A, 9B. The edge portions 9A, 9B in this instance are rounded. The receiving means 15 at each end 11, 13 of the member 17, for each edge portion 9A, 9B, comprises a bore 19, preferably cylindrical, extending longitudinally into each edge portion 9A, 9B from each end 11, 13 of member 17. Preferably, the bores 19 extend completely longitudinally through the member 17 from end 11 to end 13 in each edge portion 9A, 9B. The central portion 21 of the member 17 between through bores 19, can be hollow to lighten the member and to save material. The member 17 can be extruded. Each panel member 3 has a narrow, bridging locating member 31 along its vertical edges 9. Each locating member 31 has a longitudinal, centrally located shoulder 33 on its inner face 35 which face 35 lies adjacent edge of the panel 3 as is apparent from FIG. 3. Shoulder 33 is located in a central groove 41 in edge 7'.A central, longitudinal groove 43, with a rounded bottom is provided in the outer face 45 of member 31. Groove 43 receives one edge portion 9A or 9B of bridging member 17 as will be described. Screws 47 attach locating members 31 to core 39.

The locating members 31, if desired, can have longitudinal side channels 49 in their side faces 51 as well. Opposed grooves 53 are provided in the sidewalls 55 of the channels 49 adjacent side face 51. A hanger strip 57 slides into grooves 53 closing channel 49. The hanger strip 57 has a series of equally spaced apart, longitudinal slots 59 along its length. The slots 59 can be used to receive hangers (not shown) which support shelves on the panels.

Figure 3:
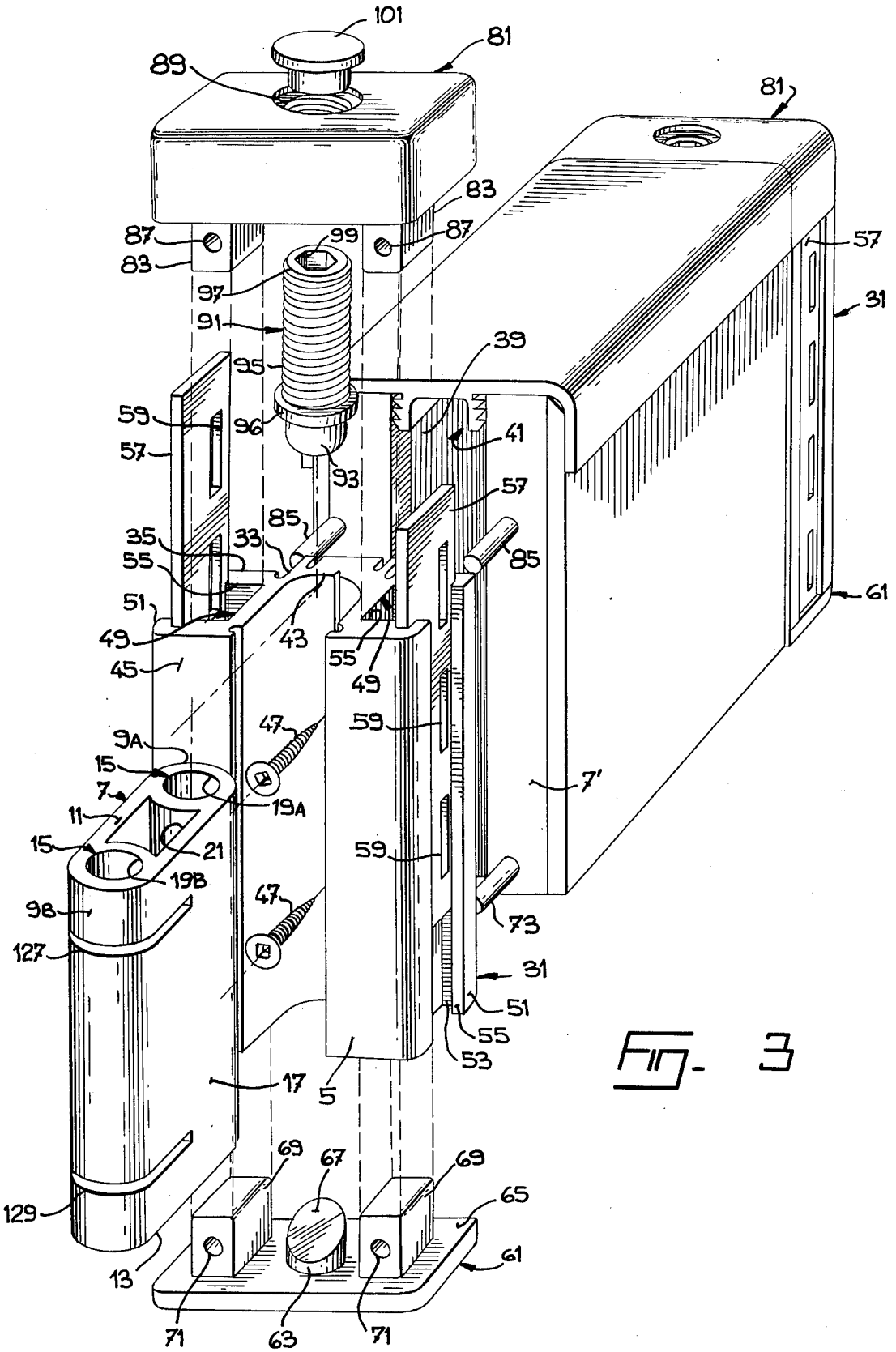
FIG. 3 is a perspective, exploded detail view showing a divider panel and a bridge member.

A toe plate 61 is provided at the bottom of locating member 31 as shown in FIG. 3. The toe plate 61 closed off the bottom of member 31 and supports hanger strips 57 on each side of member 31. In addition, the toe plate 61 carries a short connector pin 63 which projects up from the top face 65 of plate 61. The pin 63 is positioned, when plate 61 is attached to locating member 31, to lie centrally along the center line of groove 43 in member 31. The top face 67 of pin 63 slopes down toward the front or outer face 45 of member 31. Mounting blocks 69 extend up from the top face 65 of plate 61, on either side of pin 63, into the side channels 49 on member 31. The blocks 69 have holes 71 for receiving pins 73 which are inserted in member 31 to hold plate 61 in place.

A toe plate 81 is also provided to close the top end of locating member 31 as shown in FIG. 3. The top plate 81 has a pair of mounting blocks 83 extending down from its bottom face into side channels 49 on member 31. Pins 85, inserted in member 31, pass through holes 87 in blocks 83 to hold plate 81 on the end of member 31. The top plate 81 has a central, vertical through hole 89. The hole 89 is threaded and receives a top connecting pin 91 which pin has a lower rounded end 93 and a threaded shank 95. The end 93 and shank 95 are separated by a flange 96. The upped end 97 of the pin has a socket 99 for receiving a wrench. The pin 91 is threaded into hole 89 and can be raised or lowered relative to plate 81 and member 31. A cap 101 normally closes the top of hole 89.

Figure 4:
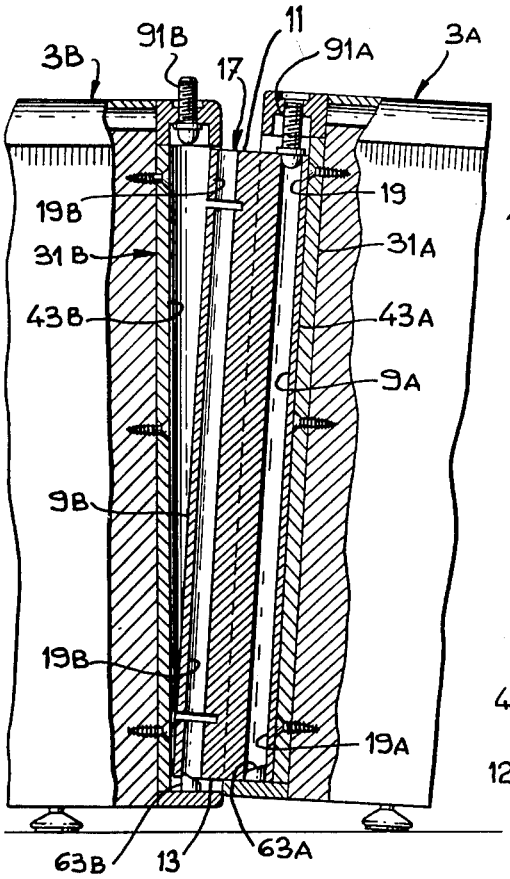
FIG. 4 is an elevation view on partial cross-section showing a single bridge member joining two divider panels of the same height.
Figure 5:
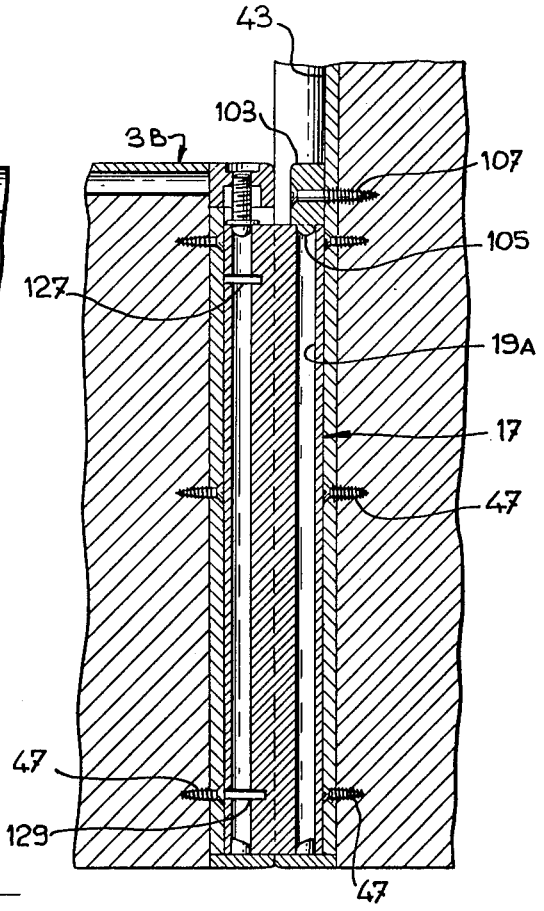
FIG. 5 is a cross-sectional elevation view showing a single bridge member joining two divider panels of different height.

In use, as shown in FIGS. 4 or 5 a bridging member 17 is positioned adjacent the locating member 31A of a first panel 3A. The top connecting pin 91A on panel 3A is first raised and bridging member 17 is positioned to place one edge 9A into groove 43A with bore 19 at the lower end 13, receiving bottom connecting pin 63A. The member 17 is pushed to have edge 9A flush against the bottom wall of groove 43A and top connecting pin 91A is then lowered into bore 19A at the top end 11 to lock member 17 to panel 3A.

The panel 3A, with member 17 attached to it, is then moved against panel 3B. Panel 3A is slightly raised so as to lift the bottom end 13 of member 17 over bottom connecting pin 63B on locating member 31B and to drop it with bore 19B receiving pin 63B. Edge 9B then lies flush in groove 43B, and top connecting pin 91B is then lowered into bore 19B at top end 11. A series of panels 3 can be connected together in this manner using bridging members 17 to form a straight wall.

Panels 34 of different height can be connected together in a similar manner. With taller panels, as shown in FIG. 5 a top connecting block 103, having a rounded projection 105 on its bottom fance, is attached in groove 43 by a screw 107. The projection 105 fits within bore 19A of bridging member 17 in the same manner as the lower end 93 of connecting pin 91.

It will be apparent that the bridging means 7 can comprise a plurality of single bridging members 17 only when a plurality of panels 3 are to be joined together to form a substantially straight wall. The straight side walls of groove 43 in locating member 31 prevent adjoining panels 3 from being set at an angle to one another. To provide more flexibility, permitting the panels 3 to be joined together in a straight or angled wall, the bridging means can comprise two or more bridging members 17 used to form a bridging assembly 125. In order to form a bridging assembly 125 from two or more bridging members 17, each bridging member 17 is provided with two transverse slots 127, 129 adjacent each end 11, 13 respectively, as shown in FIG. 3. The slots 127, 129 are provided along one edge 9B only of member 17 and intersect bore 19B. The slots 127, 129 receive links 131 used to connect two or more bridging members 17 together. The bridge members 17, connected with links 131, form a bridging assembly 125 for use in connecting panels together.

Figure 6:
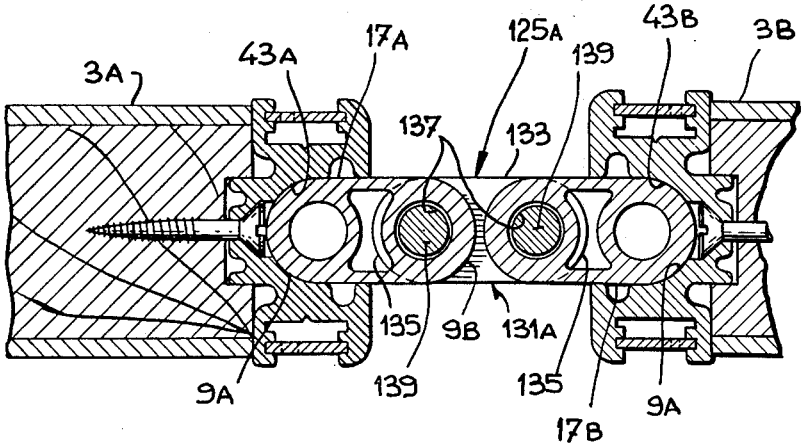
FIG. 6 is a cross-sectional view showing two bridge members joining two divider panels.

As shown in FIG. 6, in one embodiment, the bridging assembly 125A can comprise two bridging members 17A, 17B joined by two link 131A. Links 131A each comprise flat, elongated members 133 having rounded end 135 and a threaded hole 137 at each end 135. The ends 135 of each link 131A are inserted into adjacent slots 127 and 129 of adjacent edges 9B of two adjacent bridging members 17A, 17B. A bolt 139 is inserted into the bores 19 in adjacent edges 9B of members 17A, 17B from each end. The four bolts 139 are threaded into holes 137 of links 131A to form the assembly 125A. The assembly 125A is then used to join adjacent panels 3A, 3B in the same manner as the single member 17 joined the panels, with the edge 9A of one member 17A inserted into groove 43A of panel 3A and the edge 9A of the other member 17B inserted into groove 43B of panel 3B. Connecting pins 63, 91 on both panels 3A, 3B cooperate with the bores 19 adjacent free edges 9A of the membes 17A, 17B to connect assembly 125A with panels 3A, 3B. As will be apparent from FIG. 6, the assembly 125A, employing links 131A, permits panels 3A, 3B to be joined at an angle to each other.

Figure 7:
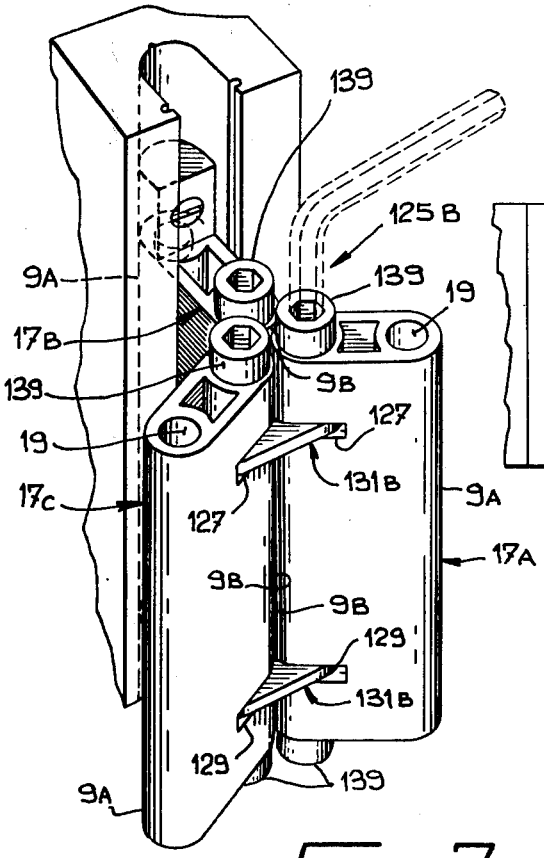
FIG. 7 is a perspective view showing a bridge assembly of three bridge members for connecting three divider panels together.
Figure 8:
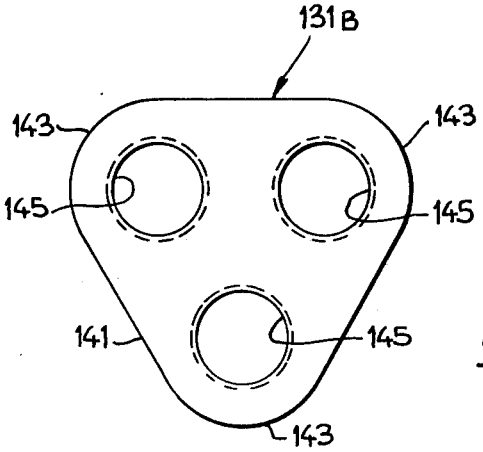
FIG. 8 is a plan view of a link member used in forming the bridge assembly of FIG. 7.

In another embodiment of the invention, as shown in FIGS. 7 and 8, the bridging assembly 125B can comprise three bridging members 17A, 17B and 17C, each with slots 127, 129, joined together by two links 131B. Each link 131B comprises a flat, triangular member 141 having rounded corners 143. A threaded hole 145 is provided in each corner 143. The three bridging members 17A, 17B and 17C are positioned with their edges 9B adjacent each other. The other edges 9A can be located 120° from each other as shown in FIG. 7. Alternatively, two of the edges 9A can be opposed to each other with the other edge located 90° from the two opposed edges. The triangular links 131B are located within the transverse slots 127, 129 of the three members 17A, 17B, 17C at both the top and bottom ends 11, 13. Bolts 139 are inserted into the bores 19 in each member 17A, 17B, and 17C and threaded in threaded holes 145 in member 141 to form assembly 125B. The assembly 125B can then be joined, by the free edges 9A of members 17A, 17B and 17C, to three panels 3 in the manner previously described in joining members 17 to panels 3.

Figure 9:
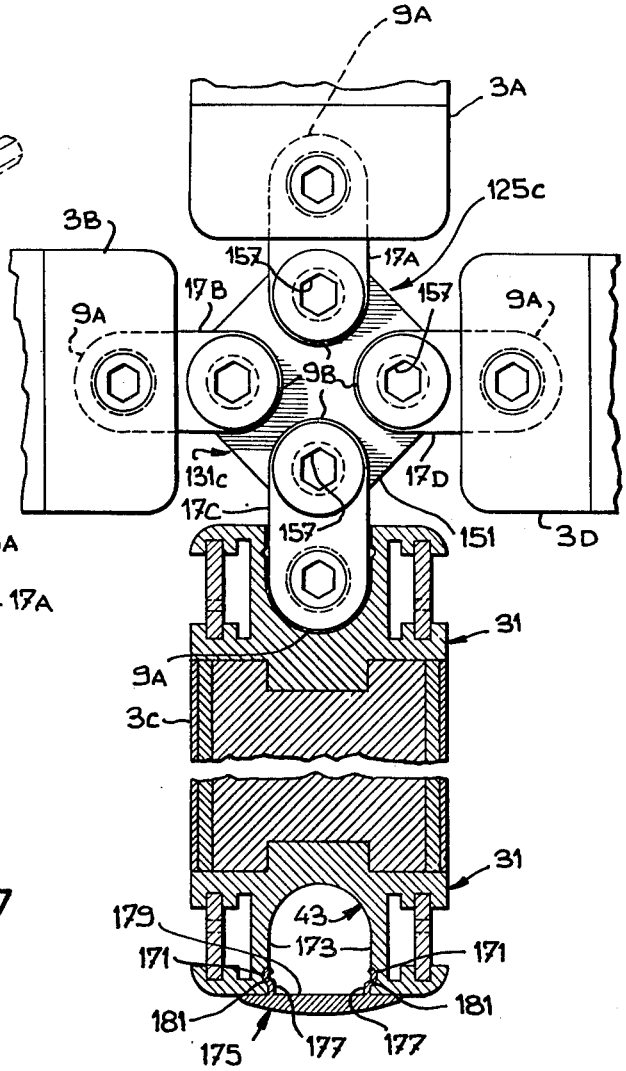
FIG. 9 is a plan view, in partial cross-section, showing a bridge assembly employing four bridge members connecting four divider panels together.

In still another embodiment of the invention, bridging members 17A, 17B, 17C and 17D can be combined to form a bridging assembly 125C which can be used to join four panels 3A, 3B, 3C and 3D together in a cross formation as shwon in FIG. 9. In this embodiment, the connecting links 131C, employed to fit in the slots 127, 129 in the adjacent edges 9B of the four members 17A, 17B, 17C and 17D, each comprise a flat square member 151. Member 151 has a threaded hole at each of its corners. The holes when the corners of the links 131C are inserted into slots 127, 129 in members 17A, 17B, 17C and 17D, intersect the bores in the members adjacent edges 9B. Bolts 157 are inserted into the bores 19 from each end of the members 17 and are threaded in the holes in the corners of the links 131C. The bolts 157 and links 131C join the members 17A, 17B, 17C and 17D together to form the bridging assembly 125C. the free projecting edges 9A of the members 17 of assembly 125C are inserted in the grooves in the locating members 31 on the edges of the panels 3A, 3B, 3C and 3D. Connecting pins 63 and 91 connect the panels to the assembly 125C as before.

Each central locating groove 43 in the locating members 31 on the panels 3 can be provided with a secondary groove 171 on each side wall 173 of the groove adjacent the outer face 45 of the member. A cap strip 175, as shown in FIG. 9, can be used to close the locating groove 43 in the panel when needed. The strip 175 has a pair of resilient fingers 177 projecting from its inner face 179. The fingers 177 each have a protuberance 181 on their outer surface. When the cap strip 175 is placed over the groove 43, the fingers 177 lie along the sidewalls 173 of the groove and the protuberances 181 snap into the secondary grooves 171 to hold the cap 175 in place.

Figure 10:
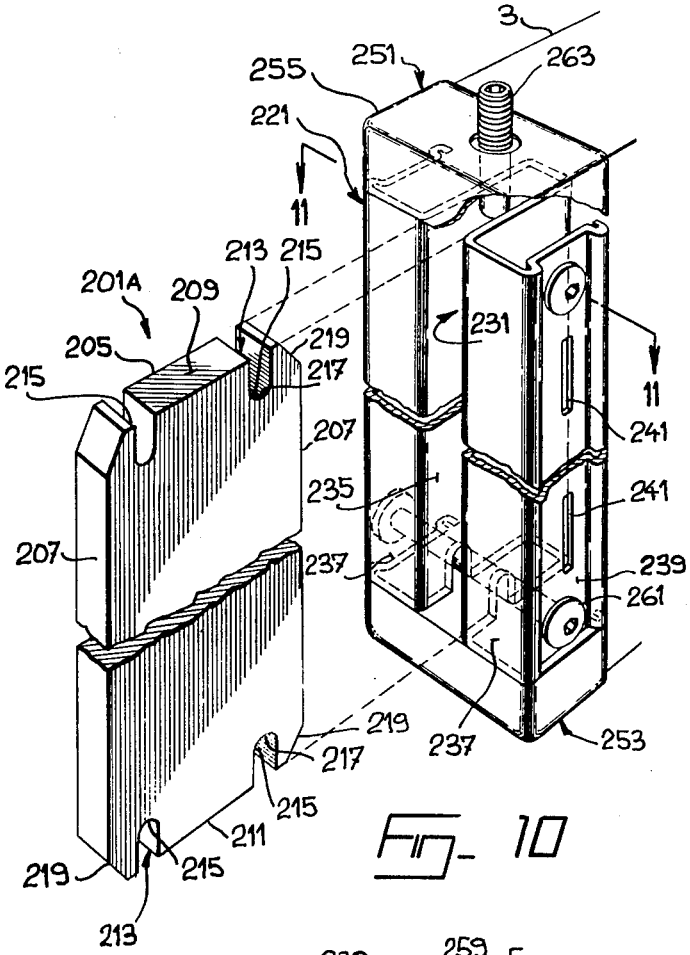
FIG. 10 is a perspective view showing a second embodiment of a bridge member and one end of a divider panel adapted to receive this bridge member.
Figure 12A:
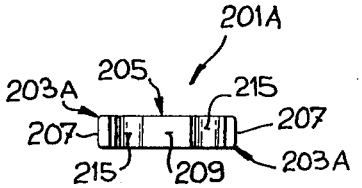
FIGS. 12A, 12B, 12C and 12D show views of different bridge members of the second embodiment type for joining divider panels together.
Figure 11:
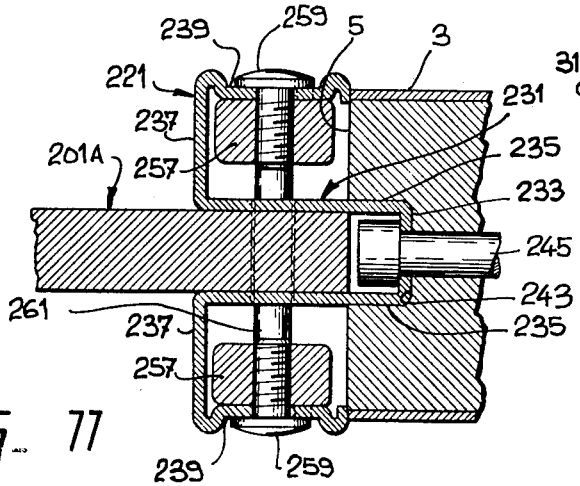
FIG. 11 is a cross-sectional view showing the bridge member and divider panel of FIG. 10 connected together.

In a further embodiment of the invention the bridging means 7 can comprise a single bridging member 201 having two, three or four projecting edges 203 to join two, three or four panels 3 together. In one version, as shown in FIGS. 10, 11 and 12A, the bridging member 201A can comprise a flat, elongated member 205 having a narrow rectangular cross-section. The two longitudinal narrow edges 207 of the member 205 form the projecting edges 203A. The ends 209, 211 of member 205 each having receiving means 213 for receiving connecting members from the panels 3 to be connected. In this embodiment the receiving means 213 comprise a notch 215 extending longitudinally from ends 209 or 211 adjacent each edge 207. The notches 215 can have a rounded bottom 217. The corners 219 of the member 205 can be bevelled.

The panels 3 are provided with locating members 221 along their end edges 5 for receiving the bridging member 201A. In this embodiment, the locating member 221 has a central, U-shaped channel portion 231 with a straight, short bottom wall 233 and parallel sidewalls 235. End walls 237 extend in opposed directions transversely from the ends of sidewalls 235. The end walls 237 are parallel to bottom wall 233. Outer walls 239 extend from the ends of end walls 237 toward bottom wall 233. The outer walls 239 are parallel to sidewalls 235. A row of elongated, spaced apart, slots 241 can be provided in outer walls 239 to support hangers. The locating member 221 is placed adjacent edge 5 of panel 3, with the bottom of channel portion 231 positioned in a longitudinal, central groove 243 in edge 5 of panel 3. The free ends of outer walls 239 bear against edge 5 and fastening members 245 in channel 231 attach member 221 to panel 3.

Top and bottom caps 251, 253 close the top and bottom ends of member 221. Top cap 251 can comprise a block member 255 covering the top end of member 221. Two locating projections 257 extend down from member 255 to lie adjacent the interior surface of outer walls 239. Bolts 259 pass through outer walls 239 into projections 257 to connect top cap 251 to member 221. Bottom cap 253 has similar projections extending up from its top surface and lying adjacent the interior surface of outer walls 239. A single double headed bolt 261 passes between the outer walls 239 and the projections to connect bottom cap 253 to member 221. Bolt 261 traverses channel 231. The top cap 251 carries a threaded bolt 263 which extends through a bore in the top cap 251 down into channel 231. The bolt 263 is adjustable.

In operation, panels 3, having members 221 along their vertical edges, can be joined by bridging members 201A, to form a straight wall portion, each bridging member 201A is placed with one projecting edge 203A in channel 231 of member 221 in one panel 3 and with its other projecting edge in a channel in a member 221 on an adjacent panel 3. The member 201A is placed with its two bottom notches 215 hooked over the bottom bolts 261 in the members 221. Top bolt 263 is initially raised in the panels, and then lowered into the top notches 215 of the bridging members 201A after they have been positioned on bottom bolts 261.

Figure 12B:
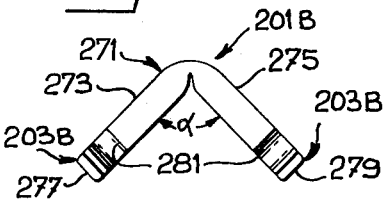
Figure 12C:
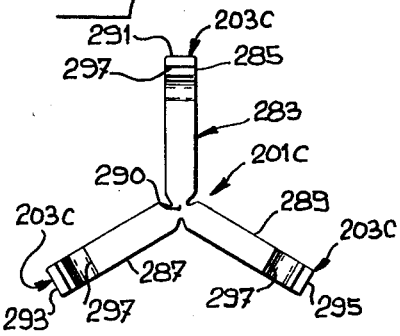
Figure 12D:
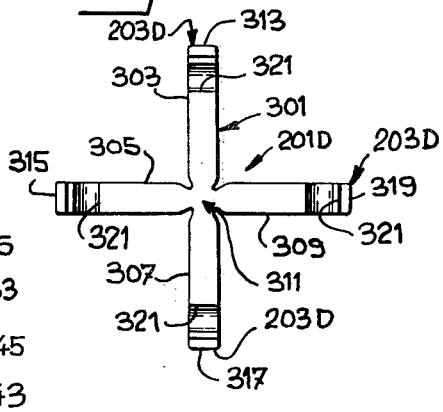

To connect two panels 3 together at right angles (or at any other angle), the bridging member 201B can comprise an angled elongate member 271 having two arms 273, 275 extending at an angle to each other, as shown in FIG 12B. This angle may be slighty variable. The arms 273, 275 are joined along one longitudinal edge. The other free edges 277, 279 of arms 273, 275 from the projecting edges 203B. Notches 281 are provided in both ends of member 271 adjacent each free edge 277, 279, extending longitudinally inwardly from the ends. The member 201B connects two panels 3 together at an angle to each other.

The bridging member 201C can comprise a single elongate member 283 with three arms 285, 287, 289, equally spaced apart, extending radially, from a central point 290 where they are joined together along one edge. The free edges 291, 293, 295 of the arms form the projecting edges 203C of member 201C. Notches 297 are provided in both ends of member 283 adjacent each edge 291, 293, 295. Member 201C permits three panels to be joined together.

A bridging member 201D can also comprise a single elongate member 301 having four arms 303, 305, 307, 309, equally spaced apart, extending radially from a central point 311 where the arms are joined together along one edge. The free end edges 313, 315, 317, 319 of the arms form projecting edges 203D and notches 321 are provided in arms 303, 305, 307, 309 at each end adjacent edges 203D. Member 201D permits four panels to be joined together in a cross formation.

The members 201A, 201B, 201C and 201D can be used in combination with panels 3 to form space divider assemblies of various configurations.

I claim:

1. A space divider assembly comprising a bridge means joining together a number of structural wall panels each having vertically extending connecting means on vertical edges thereof, along adjacent vertical edges, the bridge means having projecting edges equal in number to the number of panels to be joined together, receiving means at each end of each projecting edge, the receiving means extending longitudinally inwardly of the bridge means from each end and receiving the vertically extending connecting means on the panels.

2. Bridge means as claimed in claim 1, wherein said panels have differing heights, and the bridge means has a longitudinal length substantially equal to the height of the shortest of the panels to be joined together, and each projecting edge having a length substantially equal to the length of the bridge means.

3. Bridge means as claimed in claim 1 wherein the bridge means comprises a single, elongate bridge member.

4. Bridge means as claimed in claim 3 wherein the single bridge member has a narrow, substantially rectangular cross-section, the opposed narrow edge portions of the member forming two opposed projecting edge portions.

5. Bridge means as claimed in claim 4 wherein the receiving means comprise a bore hole.

6. Bridge means as claimed in claim 4 wherein the receiving means comprise a notch.

7. Bridge means as claimed in claim 3 wherein the bridge member comprises a member having three arms extending radially from a central point, the free edges of the arms forming three projecting edge portions.

8. Bridge means as claimed in claim 3 wherein the bridge member comprises a member having four arms extending radially from a central point, the free edges of the arms forming four projecting edge portions.

9. Bridge means as claimed in claim 3 wherein the bridge member comprises an angled member having a pair of arms extending at an angle to each other, the arms joined along adjacent longitudinal edges, the free edges of the arms forming two projecting edge portions.

10. Bridge means as claimed in claim 9, wherein each arm has a notch at each end adjacent its free edge forming the receiving means.

11. Bridge means as claimed in claim 3 wherein the bridge means comprises a bridge assembly consisting of at least two elongate bridge members, each bridge member having a narrow, substantially rectangular cross-section, the bridge members positioned with one narrow longitudinal edge of each adjacent the one narrow edge of the other members, and means connecting the members together.

12. Bridge means as claimed in claim 11 wherein the assembly comprises two elongate bridge members, and the means connecting the members together comprises two substantially rectangular link members insertable into the bridge members and connectable thereto with fasteners.

13. Bridge means as claimed in claim 11 wherein the assembly comprises three elongate bridge members, and the means connecting the members together comprises two substantially triangular link members each having their corners insertable one into each bridge member and connectable thereto with fasteners.

14. Bridge means as claimed in claim 11 wherein the assembly comprises four elongate bridge members, and the means connecting the members together comprises two substantially square link members each having their corners insertable one into each bridge member and connectable thereto with fasteners.

15. Bridge means as claimed in 11, wherein each bridge member has a bore extending in from each end adjacent each narrow longitudinal edge, the bores forming the receiving means, and each bridge member having a transverse slot adjacent each end in the said one narrow edge for receiving a portion of the link members, the slots intersecting the bores.

16. A space divider assembly comprising at least two wall panels having vertical end edges, bridge means joining the wall panels together along adjacent vertical edges, the bridge means having projecting edges equal in number to the number of panels to be joined together, each panel having a bridge locating member along its verical edge, the member having a longitudinal, central slot for receiving one projecting edge of the bridge means, the bridge means having receiving means at each end of each projecting edge, and each locating member having connecting means at each end of the slot insertable into the receiving means.

17. A space divider assembly as claimed in claim 16 wherein one of said connecting means comprises a vertical bolt vertically adjustable within the slot.

18. A space divider assembly as claimed in claim 17 wherein the other of said connecting means comprises a fixed pin projecting into the slot, the pin having its end face sloping in a direction to provide a short front portion and a long back portion.

19. A space divider assembly as claimed in claim 17 wherein the other of said connecting means comprises a fixed pin traversing said central slot at its bottom end.

20. A space divider assembly as claimed in claim 16 wherein each bridging locating member has a row of equally spaced apart, longitudinal slots in its side faces for receiving hangers.

21. Connecting means comprising a bridge means for use in joining a number of wall panels along adjacent vertical edges thereof, each panel having a bridging locating means along its vertical edge for positioning and retaining said bridge means, said bridging locating means having a groove for receiving said bridge means, said bridging locating means further having first and second receiving means for first and second positioning devices, wherein first and second positioning means for connecting said bridge means to said bridging locating means comprise said first and second positioning devices, respectively, for connecting said first and second positioning means to said bridging locating means, said first and second positioning means further comprise third and fourth positioning devices, respectively, for connecting said bridge means to said positioning means, said bridge means having third and fourth receiving means for said third and fourth positioning devices, whereby said bridge means is attached to said first and second positioning means by said third and fourth positioning devices, and said first and second positioning means are positioned with respect to said bridging locating means by said first and second positioning devices.

22. Correcting means as recited in claim 21 wherein said first and second positioning devices comprise protrusions and said first and second receiving means comprise longitudinal depressions in said bridging locating means for receiving said protrusions.

23. Connecting means as recited in claim 21 wherein said third positioning device comprises a means for applying separating force between said first positioning means and said bridge means.

24. Connecting means as recited in claim 21 wherein said first positioning means comprises a threaded hole, said third receiving means comprises a longitudinal bore having a first transverse dimension, and said means for applying separating force between said first positioning means and said bridge means comprises a threaded pin for threading in said threaded hole, said pin further having a flange having a transverse dimension greater than said first transverse dimension.

25. Connecting means as recited in claim 21 wherein said fourth positioning device comprises a fixed pin having a sloping end face for providing a short front portion and a long back portion.

* * * * *